US006651254B1

(12) United States Patent
Chang

(10) Patent No.: US 6,651,254 B1
(45) Date of Patent: Nov. 25, 2003

(54) WATERPROOF FRONT ASSEMBLY OF WATERPROOF GARMENT

(75) Inventor: Yung Sheng Chang, Taipei (TW)

(73) Assignee: J. Adams & Associates Limited, Taipei (TW)

( * ) Notice: Subject to any disclaimer, the term of this patent is extended or adjusted under 35 U.S.C. 154(b) by 0 days.

(21) Appl. No.: 10/267,932

(22) Filed: Oct. 9, 2002

(51) Int. Cl.[7] ..... A41D 3/04
(52) U.S. Cl. ..... 2/87; 2/96; 24/381
(58) Field of Search ..... 2/96, 87, 243.1, 2/82, 69, 456, 2.11, 2.15, 69.5, 2.17, 93, 102, 159, 108, 274, 275; 112/475.16, 417, 153; 24/432, 381–390

(56) References Cited

U.S. PATENT DOCUMENTS 2,148,269 A * 2/1939 Koch ..... 2/74
2,492,655 A * 12/1949 Rubin ..... 190/119
2,652,705 A * 9/1953 Weinberg ..... 66/193
3,449,764 A * 6/1969 Defazio et al. ..... 2/96
3,914,827 A * 10/1975 Brown et al. ..... 24/394
5,159,719 A * 11/1992 Aumann ..... 2/87
5,918,314 A * 7/1999 Moses ..... 2/79
6,223,349 B1 * 5/2001 Roiser ..... 2/2.17
6,571,432 B1 * 6/2003 Rindle ..... 24/432

* cited by examiner

*Primary Examiner*—Tejash Patel
(74) *Attorney, Agent, or Firm*—Ladas and Parry

(57) ABSTRACT

The waterproof front assembly of a waterproof garment having a first front panel and a second front panel in a side-by-side relationship, comprising: a zipper, a first inner storm flap attached to the first front panel, located below the zipper and extends beyond where the zipper engages, and a second inner storm flap attached to the second front panel, located below the zipper and extends below the first inner storm flap beyond where the first inner storm flap and the zipper attach to the first front panel. The inner storm flaps each include an upper layer fabric, a lower layer fabric, and a compound sandwiched between the upper and lower layer fabrics for adhering the upper layer fabric to the lower layer fabric.

12 Claims, 3 Drawing Sheets

WATERPROOF FRONT ASSEMBLY OF WATERPROOF GARMENT

BACKGROUND OF THE INVENTION

1. Field of the Invention

The present invention relates to a waterproof front assembly. Specifically, the present invention relates to a waterproof front assembly for the front shell of a waterproof garment.

2. Description of the Related Art

FIGS. 1 and 2 show a conventional waterproof jacket. The jacket has two opposite front panels and is made by stitching a plurality of the impregnated man-made waterproof shell fabrics together. The front flap assembly for the jacket is constructed by stitching two opposing and overlaying front flaps to each of the front panels, respectively, with thermal tapes underneath the stitches to create a waterproof and dry front. Two zipper tapes of the zipper are located below the two front flaps and stitched thereto. Based on the above structure, when the two zipper tapes are engaged to form a zipper, the top flap blocks rainwater and the lower flap serves as a gutter for draining away most of the rainwater.

However, as shown by the broken lines in FIG. 2, with the two front flaps located above the zipper, the front flaps will not only consume more fabric to result in a heavier gear, but the front flaps will also stress the front of the garment. The front of the gear is bulky because of the non-proportionate front flaps and feels uncomfortable to the wearer. The burden of the extra flaps also results in a situation during unzipping or undressing the gear where the user needs to first open the front flaps by separating the closure Velcro™ or snaps between the front flaps. The efforts required for separating the closure increases during bad weather and is exhausting to the user. Such a traditional workmanship, thus, has created lots of inconveniences.

FIGS. 3 and 4 show the other conventional waterproof jacket that is widely used in another type of outdoor waterproof jacket. In this instance, an inner flap is stitched to one of the front panels and below a zipper, forming a gutter between the zipper and the inner flap. To prevent the water from passing through the zipper, a waterproof zipper having two zipper tapes, such as YKK water resistant zippers, are stitched to each of the opposite front panels. The inner flap extends beyond where the two zipper tapes engage one another to further enhance the blocking effect.

Though such a design results in a clean and neat appearance, the cost of water-resistant zippers is about eight to ten times of that of regular zippers. Furthermore, the closing and opening operations in managing zipper sliders for such water-resistant zippers are relatively difficult and may require double or triple efforts. It is not uncommon for the sliders to be stuck to the teeth. If the sliders, on the other hand, are loosely designed to allow easy operations, the zipper junction will also become loose such that wind or infiltration will bring rainwater into the gap of the zipper and keeping the rainwater out will depend on the inner flap.

Another problem to using the water-resistant zippers is the limited color selection of the zippers as the zipper is specially treated, such that the manufacture commonly encounters the problem of matching the zipper color with the shell.

BRIEF SUMMARY OF THE INVENTION

An objective of the present invention is to provide a waterproof front assembly for a garment using a regular zipper but featured with a waterproof effect.

Another objective of the present invention is to provide a waterproof front assembly for a garment, which makes the front of the garment look neat and elegant.

Still another objective of the present invention is to provide a waterproof front assembly for a garment, which can reduce fabric consumption.

To achieve these objectives, the waterproof front assembly of a waterproof garment has a first front panel and a second front panel in a side-by-side relationship, comprising: a zipper, a first inner storm flap, attached to the first front panel, located below the zipper and extends beyond where the zipper tapes engages one another, a second inner storm flap, which is attached to the second front panel and is located below the zipper and extends below the first inner storm flap beyond where the first inner storm flap and the zipper attach to the first front panel. The inner storm flaps each include an upper layer fabric, a lower layer fabric, and a compound sandwiched between the upper and lower layer fabrics for adhering the upper layer fabric to the lower layer fabric.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
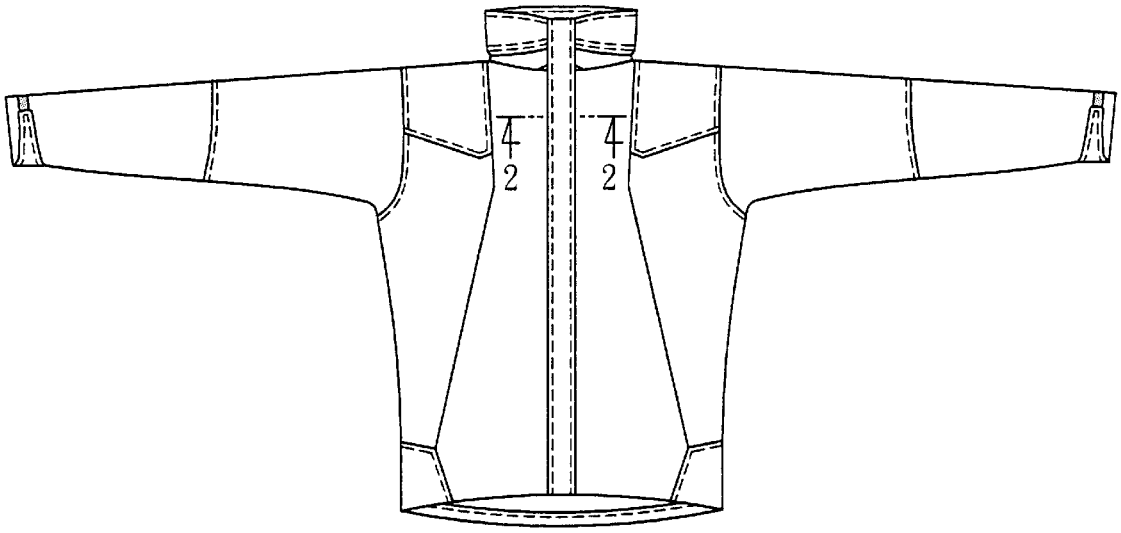
FIG. 1 is a front elevational view of a conventional jacket.
Figure 2:
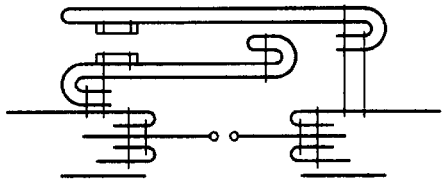
FIG. 2 is a cross-sectional view taken along Lines 2—2 in FIG. 1.
Figure 3:
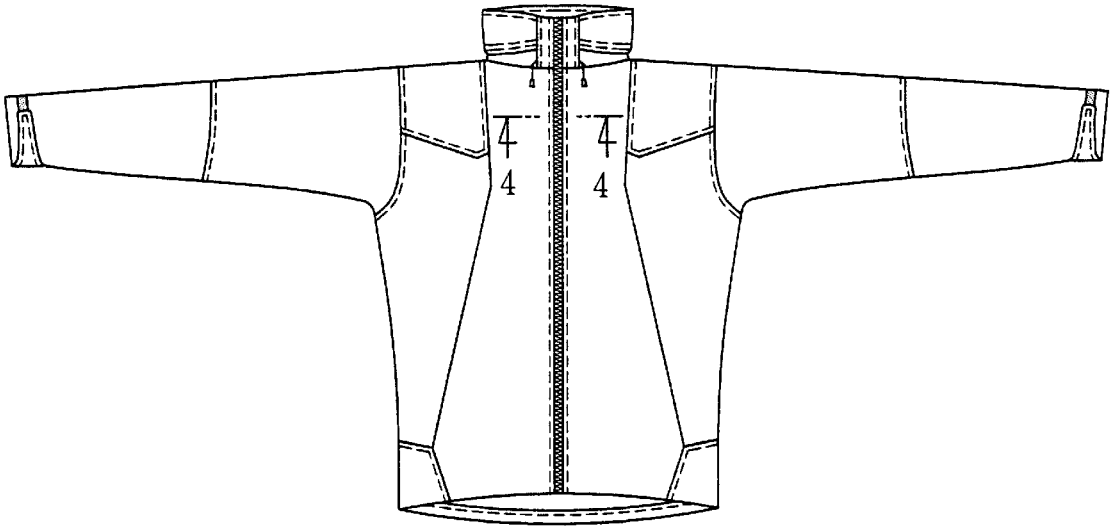
FIG. 3 is a front elevational view of the other conventional jacket.
Figure 4:
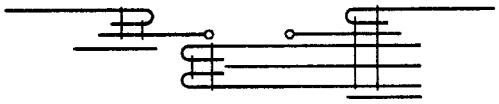
FIG. 4 is a cross-sectional view taken along Lines 4—4 in FIG. 3.
Figure 5:
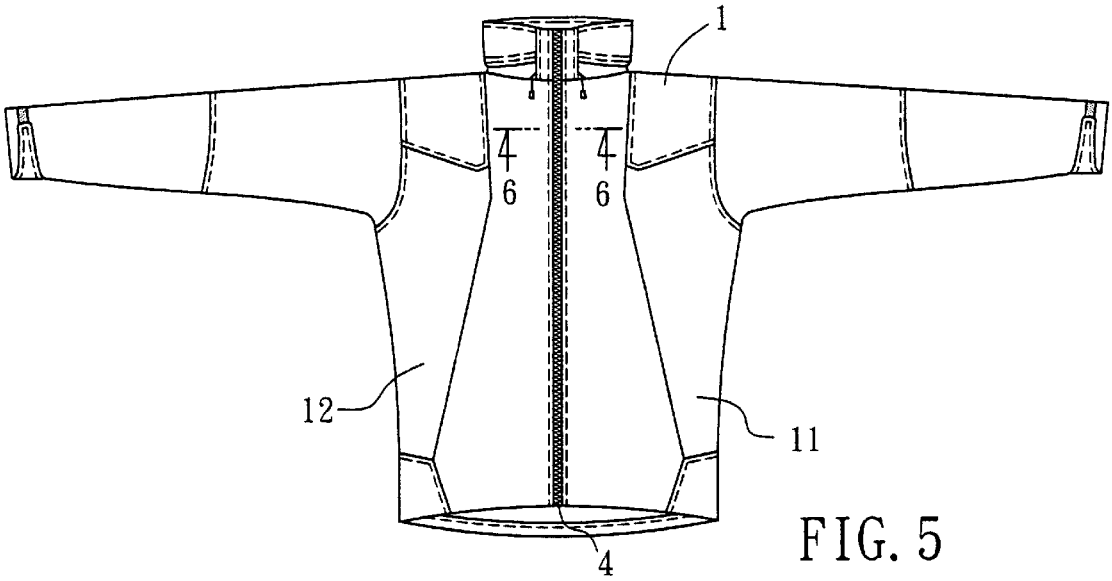
FIG. 5 is a front elevational view of a jacket in accordance with the present invention.
Figure 6:
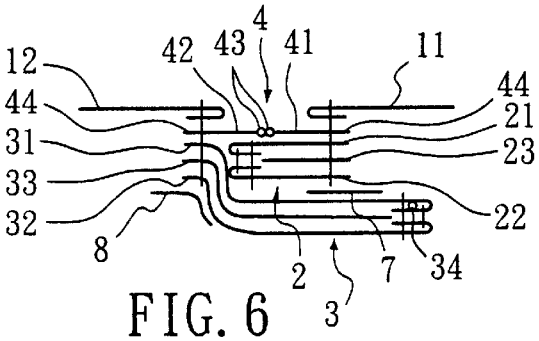
FIG. 6 is a cross-sectional view taken along Lines 6—6 in FIG. 5.
Figure 7:
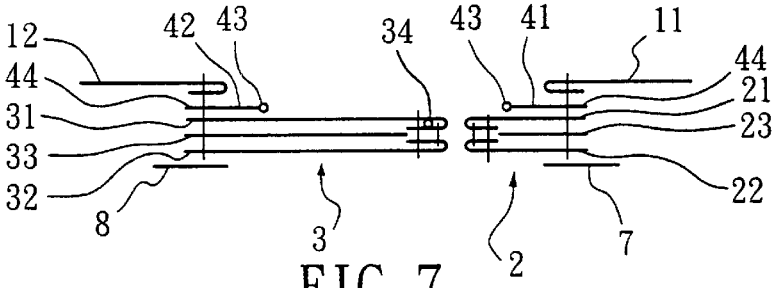
FIG. 7 is a cross-sectional view of FIG. 6, wherein the jacket is in an open state.

FIGS. 5–7 show a jacket with a waterproof front assembly in accordance with a preferred embodiment of the present invention. As shown, the jacket 1 comprises a first front panel 11 and a second front panel 12 in a side-by-side relationship.

As best seen in FIG. 6, the waterproof front assembly in accordance with the preferred embodiment of the present invention comprises a first inner storm flap 2, a second inner storm flap 3, and a zipper 4.

The zipper 4 includes a first zipper tape 41 and a second zipper tape 42 in a side-by-side relationship. Each zipper tape 41, 42 has a tooth side 43 and a free side 44. The free side 44 of the first zipper tape 41 is attached to the first front patent 11, and the free side 44 of the second zipper tape 42 is attached to the second front panel 12. The tooth sides 43 of the zipper tapes 41, 42 are engaged to each other.

The first inner storm flap 2 is attached, for example, by stitching to the first front panel 11 and located below the first zipper tape 41. The first inner storm flap 2 includes an upper layer fabric 21, a lower layer fabric 22, and a thermal meltable compound 23 (for example, a polyurethane resin) sandwiched between the upper layer fabric 21 and the lower layer fabric 22 for adhering the upper layer fabric 21 to the lower layer fabric 22. The first inner storm flap 2 preferably extends beyond where the first and second zipper tapes 41, 42 engage.

The second inner storm flap 3 is attached, for example, by stitching to the second front panel 12 and located below the second zipper tape 42. The second inner storm flap 3 includes an upper layer fabric 31, a lower layer fabric 32, and a thermal meltable compound 33 (for example, a polyurethane resin) sandwiched between the upper layer fabric 31 and the lower layer fabric 32 for adhering the upper layer fabric 31 to the lower layer fabric 32. Preferably, a cotton string 34 of about 0.10 cm in diameter is provided along a free edge of the upper layer fabric 31, so as to increase the thickness of the free edge of the upper layer fabric 31 of the second inner storm flap 3, thereby shaping the second inner storm flap 3 into a gutter for regulating the rainwater to drain downwards. The second inner storm flap 3 extends below the first inner storm flap 2 and beyond where the first inner storm flap 2 and the first zipper tape 41 attach to the first front panel 11.

After sandwiching the thermal meltable compounds 23, 33 between the upper layer fabrics 21, 31 and the lower layer fabrics 22, 32, the first and second inner storm flaps 2, 3 are heated by a thermal welding machine, which subjects the compounds of thermal meltable polyurethane resin to melt, resulting in adhesion effects, thereby ensuring and maintaining the leveling configuration of the first and second inner storm flaps 2, 3 so as to allow easy closing of the jacket.

As shown in FIGS. 6 and 7, the front flap assembly in accordance with the preferred embodiment of the present invention may further comprise a first thermal tape 7 blocking the stitching between the first zipper tape 21 and the first front panel 11, and a second thermal tape 8 blocking the stitching between the second zipper tape 22 and the second front panel 12.

In accordance with this invention, the lower layer fabrics 22, 32 of the first and second inner storm flaps 2 and 3 are made of knit tricot with polyurethane backing or polytetrafluoroethylene backing to allow easy adhesion between the thermal tapes 7, 8 and the lower layer fabrics 22, 32.

Based on the above structure, by using a thermal welding machine to heat the thermal meltable compound 23, 33 and the thermal tapes 7, 8, the molten and the cured compound 23, 33 will adhere the upper layer fabrics 21, 31 to the lower layer fabrics 22, 32, while the molten and the cured thermal tapes 7, 8 adhere to the front panels 21, 22. As such, the waterproof front assembly adopting regular zippers, in accordance with a preferred embodiment of the present invention, is constructed.

When the tooth side 43 of the zipper tapes 41, 42 are engaged with each other, the first inner storm flap 2 that preferably extends beyond where the zipper tapes 41, 42 engage one another covers up the junction of the zipper tapes 41, 42 and serves as a first gutter for passing rainwater through the zipper 4.

The second inner storm flap 3 that preferably extends beyond where the first zipper tape 41 is stitched to the first front panel 11 serves as a second gutter for passing rainwater through the zipper 4 as well as the first inner storm flap 2, thereby further enhancing the wafer proof effects.

Because both gutter edges are shaped with thermal welding, they can constantly maintain a constant shape to allow easy overlapping of the two inner storm flaps 2, 3 when the zipper 4 is zipped up. As such, there is no need to use expensive water-resistant zippers to guarantee the waterproof effects during fast moving action or under heavy rain.

Based on the dimensions of standard zippers, the first inner storm flap 2 may be of approximately 1.6cm in width and the second inner storm flap may be of approximately 3.2 cm in width.

To further improve the waterproof effect, the first and second front panels 11, 12, the inner storm flaps 2, 3, the first and second zipper tapes 41, 42 may be made of 2 or 3-layer impregnated fabrics, such as PU, PTFE, PVC, or rubber coated/laminated fabrics. However, it should be noted that while applying the present invention to other types of jackets, the shell fabrics for the jacket can also be non-impregnated, especially highly breathable fabrics, which makes the jacket a fashionable collection with seamless neat outlook.

In addition, in accordance with the present invention, the jacket eliminates an extra piece fabric stressed on the front, which reduces the fabric consumption and makes the jacket look neat and elegant.

The structure of the present invention is not limited to the above embodiments. Although the invention has been described with reference to the preferred embodiments, it will be obvious to persons skilled in the art that various changes and modifications may be made without departing from the scope of the invention as recited in the claims.

Sequence Listing

1 jacket
11 first front panel
12 second front panel
2 outer flap
21 upper layer fabric
22 lower layer fabric
23 thermal meltable compound
3 inner flap
31 upper layer fabric
32 lower layer fabric
33 thermal meltable compound
34 string
4 zipper
41 first zipper tape
42 second zipper tape
43 tooth side of each zipper tape
44 free side of each zipper tape
5 first backing layer fabric
51 first edge
52 second edge
6 second backing layer fabric
61 first edge
62 second edge
7 thermal tape
8 thermal tape

What is claimed is:

1. A waterproof front assembly of a waterproof garment having a first front panel and a second front panel in a side-by-side relationship, the assembly comprising:

a zipper, having a first zipper tape and a second zipper tape in a side-by-side relationship, each zipper tape having a tooth side and a free side, the free side of the first zipper tape being attached to the first front patent, and the free side of the second zipper tape being attached to the second front panel, and the tooth side of the zipper tapes being engageable to each other;

a first inner storm flap, attached to the first front panel and located below the first zipper tape, the first inner storm flap including an upper layer fabric, a lower layer fabric, and a compound sandwiched between the upper and lower layer fabrics for adhering the upper layer fabric to the lower layer fabric, wherein the first inner storm flap extends beyond where the first and second zipper tapes engage;

a second inner storm flap, attached to the second front panel and located below the second zipper tape, the second inner storm flap including an upper layer fabric, a lower layer fabric, and a compound sandwiched between the upper and lower layer fabrics for adhering the upper layer fabric to the lower layer fabric, wherein the second inner storm flap extends below the first inner storm flap beyond where the first inner storm flap and the first zipper tape attach to the first front panel wherein a cotton string is provided along a free edge of the upper layer fabric of the second inner storm flap.

2. The front assembly according to claim 1, wherein the cotton string is of about 0.10 cm in diameter.

3. The front assembly according to claim 1, wherein the compound is a thermal meltable polyurethane resin and adheres the upper layer fabrics to the lower layer fabrics by heat.

4. The front assembly according to claim 1, wherein the lower layer fabrics of the first and second inner storm flaps are made of knit tricot with polyurethane backing.

5. The front assembly according to claim 1, wherein the lower layer fabrics of the first and second inner storm flaps are made of knit tricot with polytetrafluoroethylene backing.

6. The front assembly according to claim 1, wherein the free side of the first zipper tape is attached to the first front panel by stitching.

7. The front assembly according to claim 6, further comprising a first thermal tape blocking the stitching between the first zipper tape and the first front panel.

8. The front assembly according to claim 1, wherein the free side of the second zipper tape is attached to the second front panel by stitching.

9. The front assembly according to claim 8, further comprising a second thermal tape blocking the stitching between the second zipper tape and the second front panel.

10. The front assembly according to claim 1, wherein the garment is made of a 2-layer impregnated fabric.

11. The front assembly according to claim 1, wherein the garment is made of a 3-layer impregnated fabric.

12. The front assembly according to claim 3, wherein the thermal meltable polyurethane resin is heated by a thermal welding machine to result in adhesion effects.

* * * * *